US007018067B2

(12) United States Patent
Wu

(10) Patent No.: US 7,018,067 B2
(45) Date of Patent: Mar. 28, 2006

(54) FLEXIBLE DECORATION LAMP TUBE AND A METHOD FOR MANUFACTURING THE SAME

(76) Inventor: Jeng-Shyong Wu, No. 14, Alley 1, Lane 326, Shyr-Piin Road, Hsin-Chu City (TW)

( * ) Notice: Subject to any disclaimer, the term of this patent is extended or adjusted under 35 U.S.C. 154(b) by 29 days.

(21) Appl. No.: 10/792,602

(22) Filed: Mar. 3, 2004

(65) Prior Publication Data

US 2005/0195608 A1 Sep. 8, 2005

(51) Int. Cl.
*F21V 21/00* (2006.01)

(52) U.S. Cl. ..... 362/249; 362/227; 362/278; 362/806

(58) Field of Classification Search ..... 362/249, 362/227, 278, 252, 240, 806
See application file for complete search history.

(56) References Cited

U.S. PATENT DOCUMENTS

| | | | | |
|---|---|---|---|---|
| 3,633,023 | A * | 1/1972 | Castiglioni et al. | 362/219 |
| 3,894,225 | A * | 7/1975 | Chao | 362/249 |
| 4,271,458 | A * | 6/1981 | George, Jr. | 362/236 |
| 6,840,655 | B1 * | 1/2005 | Shen | 362/249 |
| 2005/0018417 | A1 * | 1/2005 | Chien | 362/103 |

* cited by examiner

*Primary Examiner*—Ali Alavi
(74) *Attorney, Agent, or Firm*—McGlew and Tuttle, PC

(57) ABSTRACT

This invention relates to a flexible decoration lamp tube, which can be formed into any shape freely, comprising a lamp string formed by a plurality of lighting elements connected in series by wires; and a transparent support body made by hollow tubular flexible insulator material, which is used to contain said lamp string; a decoration tape, which is wrapped around the tube wall of said support body to enhance its fineness; and outer cover body which is made by transparent tubular flexible insulator material to envelop said decoration tape and to fix the decoration tape between the outer cover body and the support body. This invention also relates to a method for manufacturing the flexible decoration lamp tube of this invention.

20 Claims, 6 Drawing Sheets

FLEXIBLE DECORATION LAMP TUBE AND A METHOD FOR MANUFACTURING THE SAME

BACKGROUND OF THE INVENTION

1. Field of the Invention

This invention relates to a flexible decoration lamp tube, in more detailed description, to a flexible decoration lamp tube which can be bent into various shapes as desired, for example, which can wind round frame, tree, display shelf, banister and wall etc. for decoration.

2. Description of Prior-Art

Traditionally, lamp string is formed by a plurality of small bulbs or luminescent diodes connected by wires, which can wind round ramate of a tree, or products on exhibition, banister, wall, iron window etc., so as to enhance aesthetic effect.

However, there are few colors for the above lamp string, the color for the most of them is that of the bulbs itself, which is regarded as monotone. Besides, the bulbs are provided separately and discontinuously along the electrical wires, therefore, there is still rooms for the improvement on its fineness. Furthermore, the connection part of the bulbs and the wires, such as socket, in the above lamp string is easily to contact with moisture or liquid that will result in danger of short circuit or electric shock. Therefore, there is also rooms for the improvement on durability and safety.

SUMMARY OF THE INVENTION

In as much as the problems of the prior art, the inventor of this application has developed the inventive flexible decoration lamp tube after intensive and wide research on above-mentioned lamp tube suitable for decoration use. The flexible decoration lamp tube of this invention is a stripe-like tubular type, the structure of which, from its center in the radial direction includes lamp string, hollow tubular flexible support body, decoration tape and tubular outer cover body in this order.

This invention also provides a simple manufacturing method of said flexible tubular shape decoration lamp tube comprising the steps of:

connecting a plurality of lighting elements in series by wires so as to form a lamp string;

extruding plastic material with the lamp string as the axle to form a stripe-like tubular flexible support body by a extruding forming machine, so as to hold the lamp string within the support body tube;

wrapping decoration tape around the wall of said support body; and extruding, by another extruding forming machine, another plastic material into a tube so as to cover and fix said decoration tape.

DETAILED DESCRIPTION OF A PREFERRED EMBODIMENT OF THIS INVENTION

In a preferred embodiment of the flexible decoration lamp tube of this invention, said lamp string is formed by small bulbs connected in series by wires, however, said lamp string being preferably formed by lighting diodes connected in series by wires, from viewpoint of color and energy saving. Said hollow tubular flexible support body is made of flexible transparent plastic material, such as transparent PVC (polyvinyl chloride) tube, which is usually colorless and transparent, nevertheless can be transparent with color in some cases. Said decoration tape is a transparent tape with color, which is wrapped around the outer wall of said hollow tubular flexible support body. The decoration tape can be provided with figure or pattern as desired to enhance aesthetical effect. Said tubular outer cover body is also made of the same flexible transparent plastic material as that of said hollow tubular flexible support body, i.e., transparent PVC, however, the thickness of which is evidently thinner than that of said hollow tubular flexible support body due to the fact that its function is only to cover said decoration tape and to fix said decoration tape between the outer cover body and the support body.

In a preferred embodiment of a method for manufacturing the flexible tubular shape decoration lamp tube of this invention, it comprises the steps of:

connecting a plurality of luminescent diodes in series by wires so as to form a lamp string;

extruding, by extruding forming machines, transparent plastic material, such as PVC to form a stripe-like tubular flexible shape, which contains the lamp string within the inner wall, and its inside diameter can suitably fit to the outside diameter of the luminescent diodes so as to hold the luminescent diodes, whereas the luminescent diodes can have small displacement within the inner wall during the bending of the decoration lamp tube;

wrapping the decoration tape around the outer wall of said support body so that the decoration tape can wind along the periphery of the outer wall or obliquely to the periphery of the outer wall; and extruding by another extruding forming machine, the same transparent plastic material into a tube so as to cover and fix said decoration tape.

Said decoration tape is transparent with color, preferably having figure or pattern on it, so as to display affluent and diversified aesthetic effect during the lighting of the whole flexible decoration lamp tube.

Said transparent plastic material can also be transparent with color, so that the light emitted from the lighting elements can unroll the color as desired. Various aesthetic effect can be unrolled with further cooperation with the color, figure or pattern of said decoration tape.

This invention will be described in more details according to a specific embodiment, however, which will be for illustrative purpose only, not for limitative purpose of this invention. Any modification or variation made according to the appended claims of this invention is considered within the spirit and scope of this invention, which are considered to be protected by the law.

Referring to FIG. 1, a perspective view of one embodiment of the flexible decoration lamp tube of this invention is shown, wherein part is exploded so as to show each part of the structure. FIG. 2 is a perspective view showing one embodiment of the flexible decoration lamp tube of this invention, wherein the outer cover body 4 is exploded so as to show the decoration tape 3.

As shown in FIG. 1 and FIG. 2, the flexible decoration lamp tube of this invention includes lamp string 1, hollow tubular flexible support body 2, decoration tape 3 and tubular outer cover body 4 in this order from inside to outside. The lamp string 1 is formed by lighting elements connected in series by wires; said support body 2 is made of transparent hollow tubular flexible insulator material, such as transparent PVC tube, which is used to contain said lamp string 1; said decoration tape 3 is wrapped around the tube wall of the support body 2 along the periphery of the outer wall of the support body 2 at a predetermined separating distance (i.e. wrapping pitch); said tubular outer cover body 4 is made of transparent tubular flexible insulator material with its function to cover said decoration tape 3 and to fix said decoration tape 3 between the outer cover body 4 and the support body 2.

Referring to FIG. 3, another embodiment of the decoration flexible lamp tube of this invention is shown, wherein the outer cover body 4 is exploded to show the decoration tape 3. The difference between the wrapping method in FIG. 3 and that in FIG. 2 is that the decoration tape 3 is wrapped around obliquely to the periphery of the outer wall of the support body 2, and the side edges of the decoration tape 3 is adjacent with each other without any gaps there between.

Referring to FIG. 4 and FIG. 5, different wrapping methods of the decoration tapes 3 in FIG. 2 and FIG. 3 are shown respectively. Referring to FIG. 6 and FIG. 7, a decoration tape 3 with star pattern is especially shown.

Referring to FIG. 8, a flexible decoration lamp tube similar to that shown in FIG. 5 is shown, however, with the outer cover body 4 being additionally shown.

Referring to FIG. 9, a wrapping method of the decoration tape 3 in FIG. 2 and FIG. 3 is shown, wherein plastic material is extruded by a extruding forming machine with the lamp string 1 as the axle to form a stripe-like hollow tubular flexible support body 2, so as to hold the lamp string 1 within the tube of the hollow tubular flexible support body 2; and the decoration tape 3 is wrapped around the wall of said support body, and another plastic material is extruded, by another extruding forming machine, into a tubular cover body (not shown) so as to fix said decoration tape 3 onto the hollow tubular flexible support body 2.

When in use, therefore, the flexible decoration lamp tube of this invention can be bent, hung or wounded into various shapes, and can be fixed onto the ramate of a tree or banister of a garden etc. When the lamp string 1 is energized with electric current, the light emitted can transmit through flexible support body 2, decoration tape 3 and tubular outer cover body 4, so as to exhibit diversified figure and color. The figure exhibited is the shape or pattern resulted from the bending of the decoration lamp tube, and the shape or pattern of the decoration tape 3 etc.

BRIEF DESCRIPTION OF THE ACCOMPANIED DRAWINGS

Figure 1:
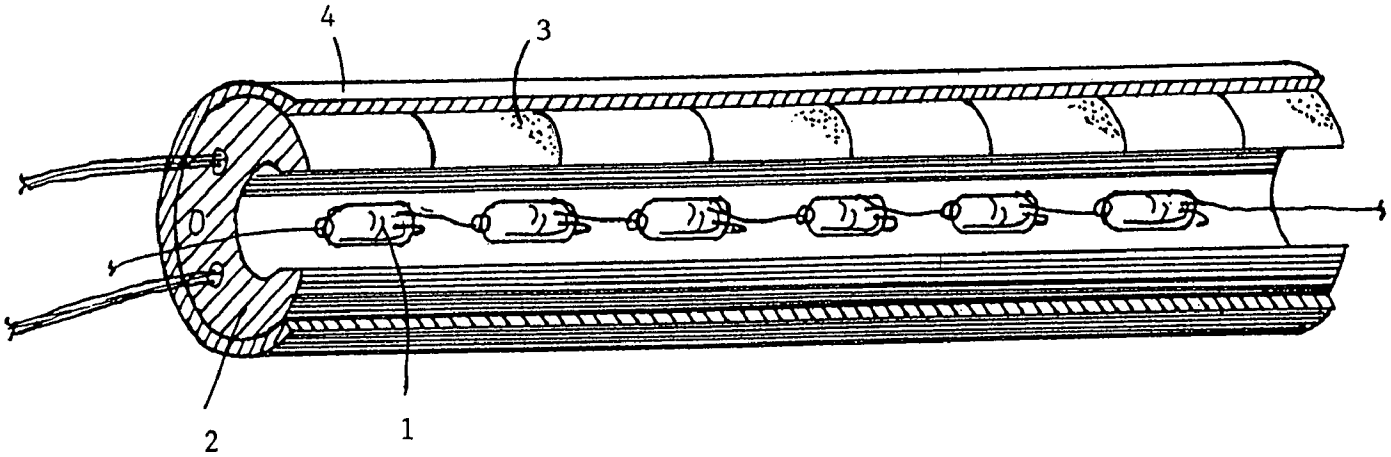
FIG. 1 is a perspective view showing one embodiment of the flexible tubular decoration lamp of present invention, wherein part of it is exploded so as to show each part of structure.
Figure 2:
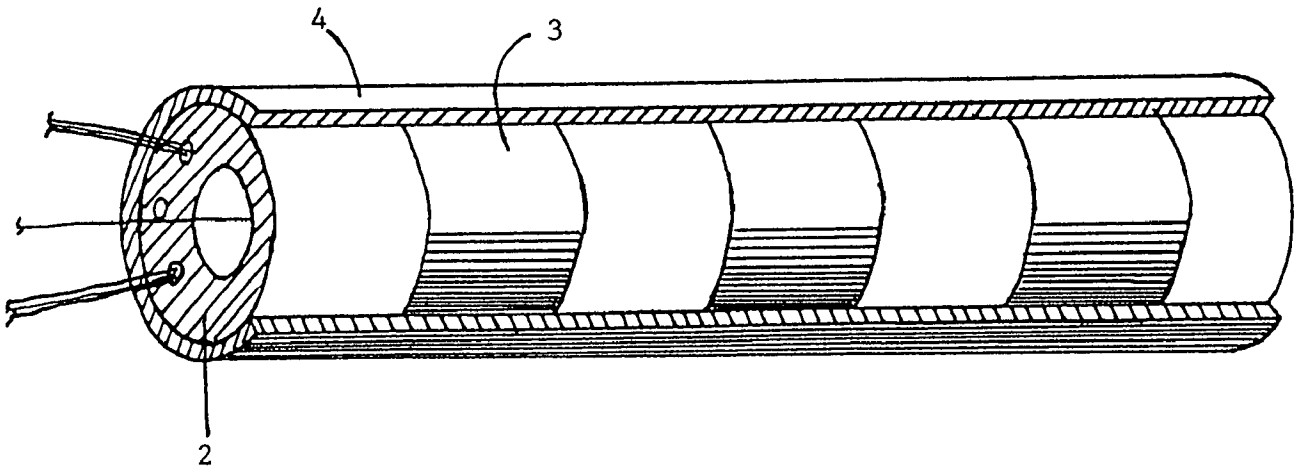
FIG. 2 is a perspective view showing an embodiment of the flexible tubular decoration lamp of present invention, wherein the outer cover body is exploded so as to show the decoration tape.
Figure 3:
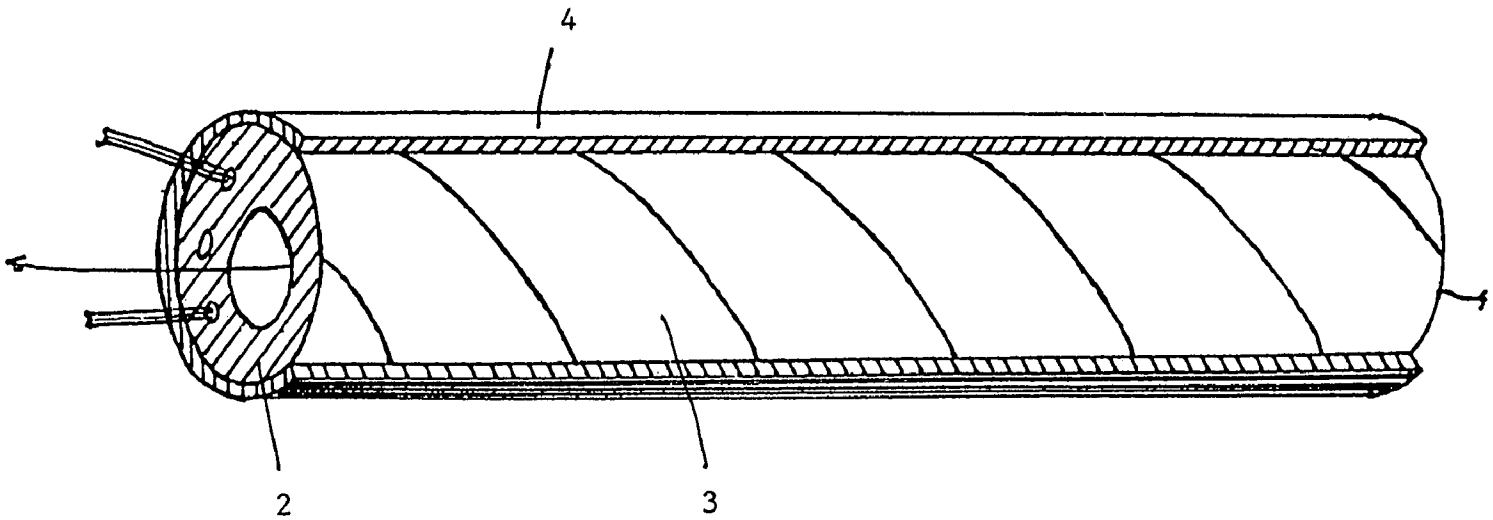
FIG. 3 is a perspective view showing an embodiment of the flexible tubular decoration lamp of present invention, wherein the outer cover body is exploded so as to show the decoration tape.
Figure 5:
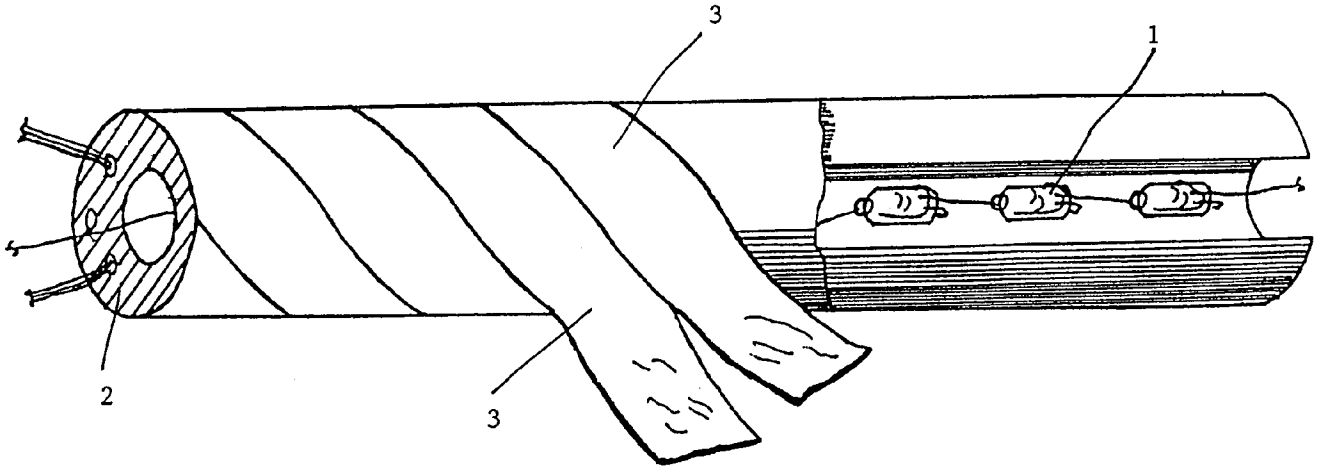
FIG. 4 and FIG. 5 show different wrapping method of the decoration tapes shown in FIG. 2 and FIG. 3 respectively.
Figure 4:
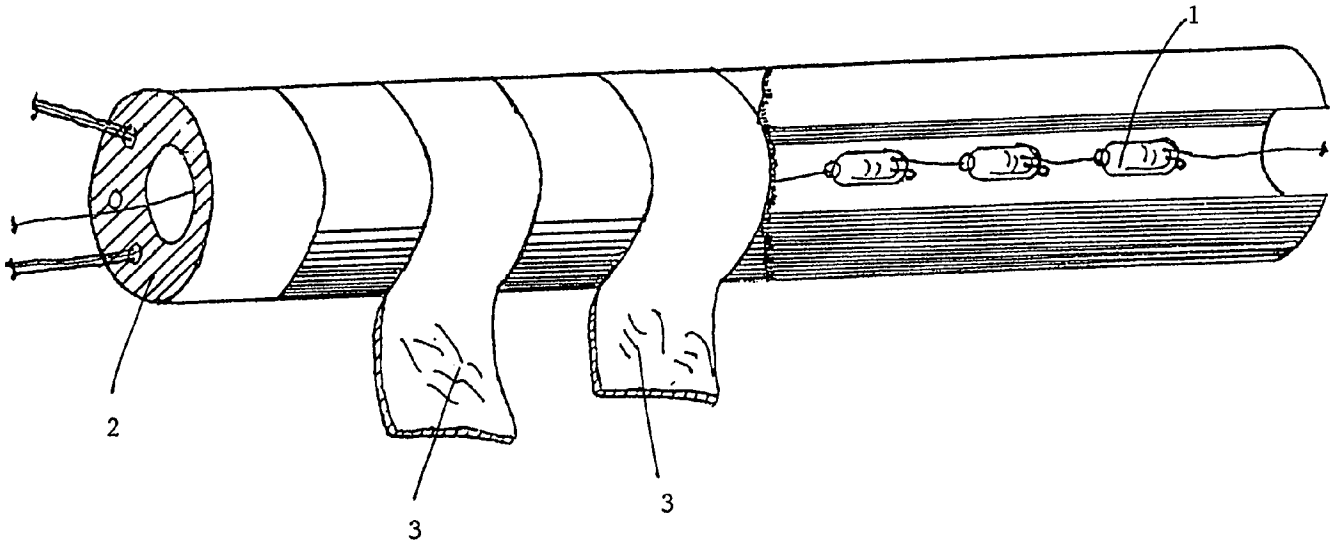
Figure 7:
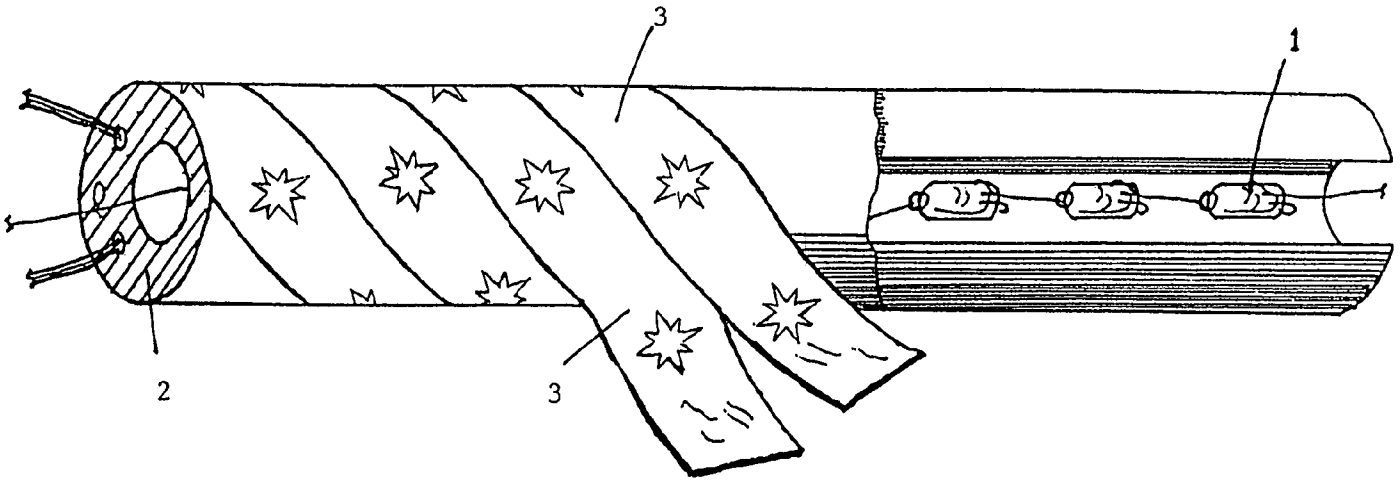
Figure 6:
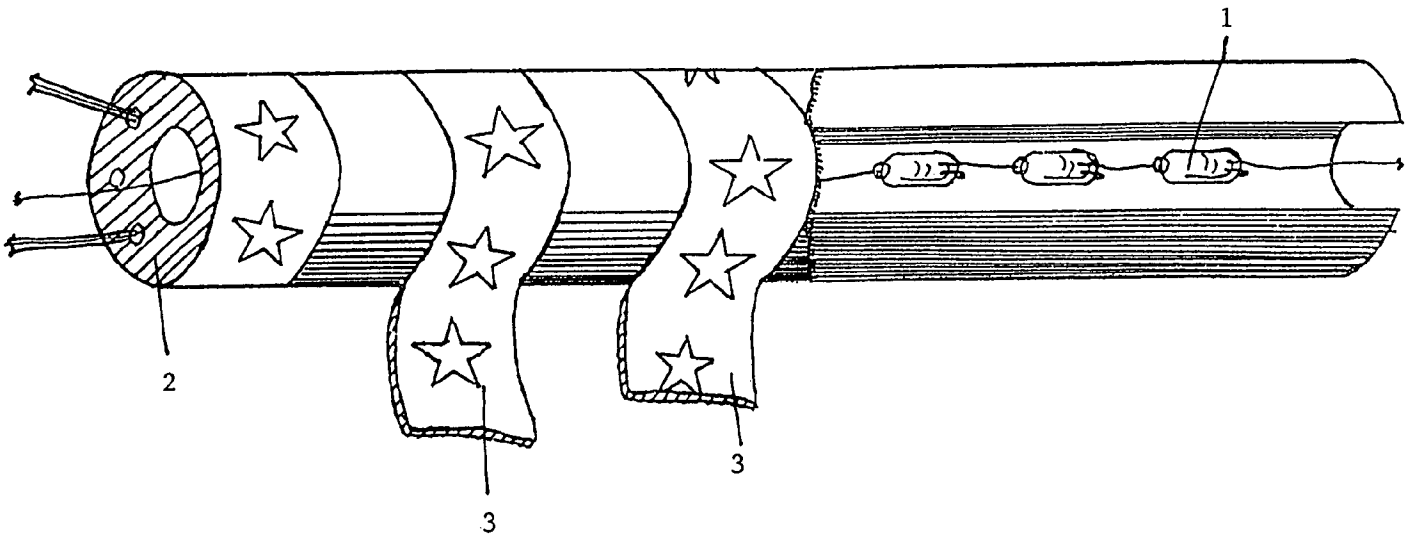
Figure 8:
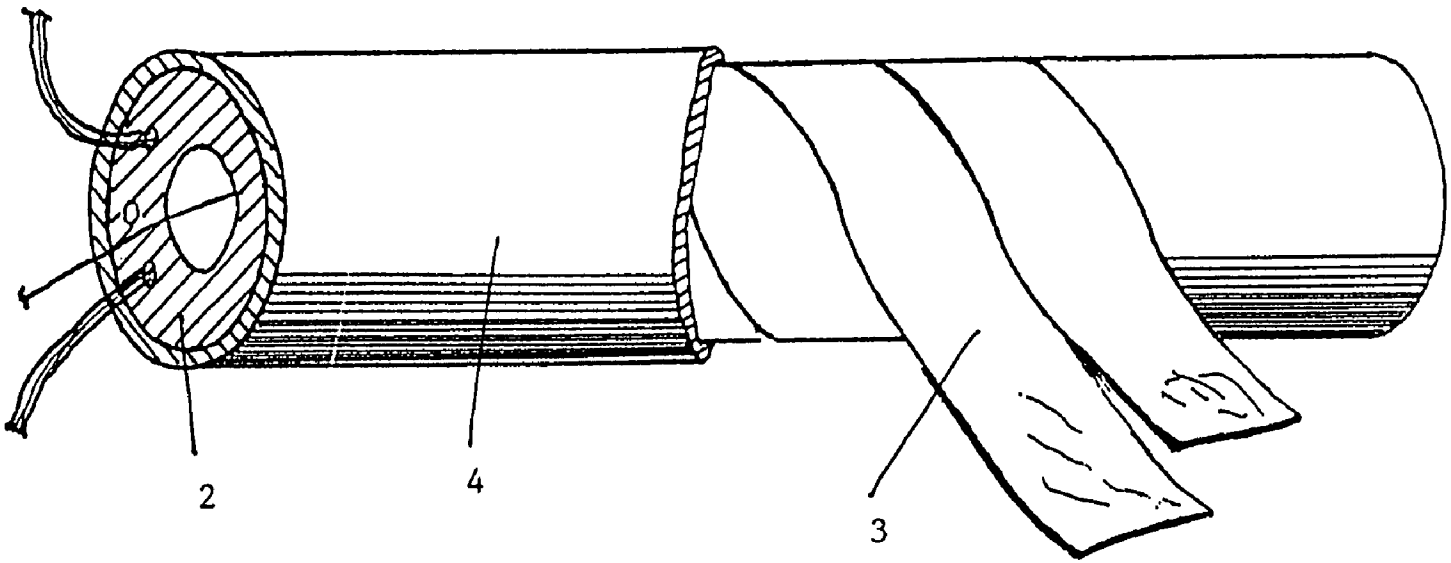
Figure 9:
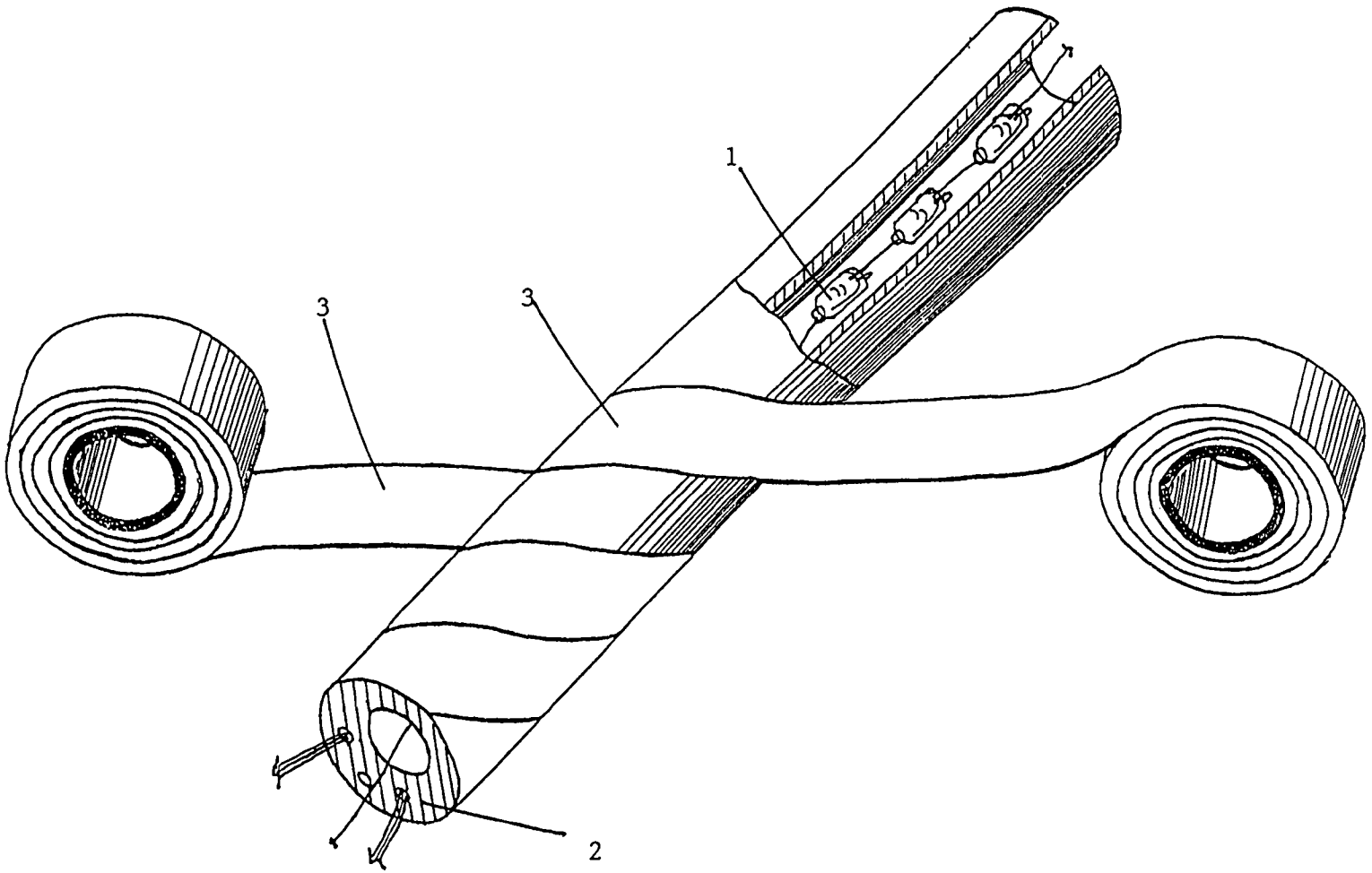

FIG. 6 and FIG. 7 especially show the decoration tapes with star patters;

FIG. 8 shows a flexible decoration lamp tube similar to that shown in FIG. 5, however, with the outer cover body 4 being additionally shown;

FIG. 9 is a schematic view showing another wrapping method of the decoration tape of the flexible tubular decoration lamp of present invention.

SYMBOLIC LIST OF COMPONENTS

1 lamp string
2 hollow tubular flexible support body
3 decoration tape
4 tubular outer cover body

What is claimed is:

1. A flexible decoration lamp tube, which can be formed into various shape freely, the lamp tube comprising:
- a lamp string, formed by a plurality of lighting elements connected in series by wires;
- a transparent support body, made of hollow tubular flexible insulator material to contain said lamp string;
- a decoration tape, wrapped around the outer tube wall of said support body; and
- an outer cover body, made of transparent tubular flexible insulator material to cover said decoration tape and to fix said decoration tape between said outer cover body and said support body.

2. A flexible decoration lamp tube according to claim 1, wherein said lighting elements are small bulbs or luminescent diodes.

3. A flexible decoration lamp tube according to claim 1, wherein said lighting elements are luminescent diodes.

4. A flexible decoration lamp tube according to claim 1, wherein the material of said support body is flexible plastic material.

5. A flexible decoration lamp tube according to claim 1, wherein said decoration tape is a translucent decoration tape with color.

6. A flexible decoration lamp tube according to claim 1, wherein the surface of said decoration tape has a figure or a pattern.

7. A flexible decoration lamp tube according to claim 1, wherein said decoration tape is wrapped along the outside wall of said transparent support body.

8. A flexible decoration lamp tube according to claim 1, wherein said decoration tape is wrapped around obliquely to the periphery of the outside wall of said transparent support body.

9. A method for manufacturing a flexible tubular shape decoration lamp tube, the method comprising the steps of:
- connecting a plurality of lighting elements in series by wires so as to form a lamp string;
- extruding plastic material with said lamp string as an axle to form a stripe-like tubular flexible support body by an extrusion forming machine, so as to hold said lamp string within said support body;
- wrapping a decoration tape around the wall of said support body; and
- extruding by another extruding forming machine, another plastic material into an outer tubular-flexible cover body so as to cover and fix said decoration tape.

10. A method according to claim 9, wherein the plastic material of said flexible support body is the same material as said another plastic material.

11. A flexible decoration lamp tube according to claim 5, wherein the surface of said decoration tape includes a figure or a pattern.

12. A flexible decoration lamp tube comprising:
- an elastically formed tubular transparent support body extending along an axis with a hollow passageway within said support body;
- a lamp string including a plurality of lighting elements inside said passageway, said plurality of lamps being connected by a connection means;

a decoration tape wrapped around the outer surface of said support body; and an elastically formed outer tubular transparent cover body extending over said decoration tape and retaining said decoration tape between said cover body and said support body.

13. A flexible decoration lamp tube according to claim 12, wherein said connection means is a set of wires connecting said plurality of lighting elements with each other in a series inside said passageway.

14. A flexible decoration lamp tube according to claim 12, wherein said connection means is a set of wires embedded inside said support body along said axis and said plurality of lighting elements are supported on said support body.

15. A flexible decoration lamp tube according to claim 12, wherein said decoration tape is formed of a material formed of at least one of a translucent color, a figure, and a design.

16. A flexible decoration lamp tube according to claim 15, wherein said decoration tape is provided as a plurality of thin strips wrapped perpendicular to the direction of said axis.

17. A flexible decoration lamp tube according to claim 15, wherein said decoration tape is a thin strip tape wrapped diagonally to the direction of said axis.

18. A flexible decoration lamp tube according to claim 15, wherein said decoration tape is a thin strip tape.

19. A flexible decoration lamp tube according to claim 12, wherein said lighting elements are small bulbs.

20. A flexible decoration lamp tube according to claim 12, wherein said lighting elements are luminescent diodes.

* * * * *